United States Patent [19]

Greiner et al.

[11] 4,205,605

[45] Jun. 3, 1980

[54] DEVICE FOR DETERMINATION OF OPERATING ANGLE OF DISTRIBUTOR ROLLERS

[75] Inventors: Harry M. Greiner, Offenbach am Main; Peter Schramm, Kahl am Main, both of Fed. Rep. of Germany

[73] Assignee: Roland Offsetmaschinenfabrik Faber & Schleicher AG, Fed. Rep. of Germany

[21] Appl. No.: 885,982

[22] Filed: Mar. 13, 1978

[51] Int. Cl.[2] ..... B41F 31/14; B41L 27/16

[52] U.S. Cl. ..... 101/206; 101/349; 101/DIG. 14

[58] Field of Search ..... 101/DIG. 14, 348, 349, 101/350, 205, 206, 207, 329, 330; 340/187

[56] References Cited

U.S. PATENT DOCUMENTS

| | | | |
|---|---|---|---|
| 2,127,455 | 8/1938 | Wood | 101/350 |
| 2,838,995 | 6/1958 | Worthington | 101/349 |
| 3,026,798 | 3/1962 | Frostad | 101/248 |
| 3,329,945 | 7/1967 | Deming | 340/187 |
| 3,345,941 | 10/1967 | Koch et al. | 101/350 |
| 3,765,328 | 10/1973 | Treff et al. | 101/DIG. 6 X |
| 3,916,791 | 11/1975 | Simeth | 101/141 |
| 4,040,347 | 8/1977 | Johne et al. | 101/349 |

OTHER PUBLICATIONS

German Printed Abstracts, (Auszuge aus den Gebrauchsmustern), vol. 22, Jun. 2, 1977, p. 887, No. 76 35 701.

*Primary Examiner*—J. Reed Fisher

*Attorney, Agent, or Firm*—Leydig, Voit, Osann, Mayer & Holt, Ltd.

[57] ABSTRACT

A control system for optimizing the starting angle of a vibrating roller for production of an evenly distributed film of ink on the printing plate of a printing press, particularly an offset press, in which a reciprocating drive connection is provided between the press drive and the vibrating roller for reciprocation of the latter. A chart is provided for each one of a complete set of reference distribution starting angles for the vibrating roller, each chart showing for each starting angle a corresponding ink density distribution curve which, when matched to the observed ink density distribution in a printed product, provides direct reading of optimum starting angle. A variable phase changer is interposed in the drive connection leading to the vibrating roller for directly setting the starting angle to optimum value. In a preferred embodiment of the invention the charts are arranged angularly spaced on a rotatable carrier disc which is coupled to a first servo device, while the phase changer is coupled to a second servo device, the servo devices being coupled together by servo circuitry for angular coincidence at an angle which is manually set. When the disc is in reference position (for example, zero), the optimum starting angle is read off the chart, following which the disc and phase changer are set, simultaneously, to the optimum angle.

3 Claims, 8 Drawing Figures

DEVICE FOR DETERMINATION OF OPERATING ANGLE OF DISTRIBUTOR ROLLERS

Figure 1C:
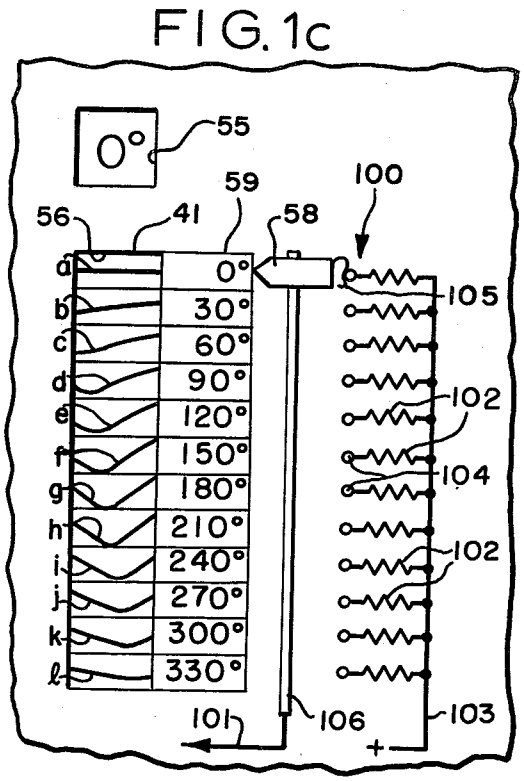

In a printing press it is customary to include, in the ink supply system, a reciprocating or "vibrating" roller for feeding ink to the form roller which then applies the ink to the plate. A vibrating roller is used to improve the lateral distribution of ink on the printed sheet but, unfortunately, the reciprocating motion has an effect upon rate of ink flow longitudinally of the sheet, with maximum flow occurring at the points of reversal of roller movement. It is desirable in securing an optimum distribution of ink to have the points of effective roller reversal fall within the gap between the edges of the plate. This may be accomplished by a variable phase changer interposed in the drive connection between the press drive and the reciprocating drive connection. The phasing is quantitatively expressed in terms of the "starting angle" of the vibrating roller.

A variable phase changer for this purpose which permits adjustment of the starting angle while the press is running is disclosed in U.S. Simeth Pat. No. 3,916,791 issued Nov. 4, 1975. In the use of the latter device the density distribution longitudinally of a printed sheet is observed, and, if improvement is called for, the operator by means of the variable phase changer changes the phase in one direction or the other, observing the new density distribution upon a second printed sheet. Observation and adjustment are repeated as often as required to bring about an optimum density distribution. The process is not only time consuming but takes a high degree of skill, and if performed while the press is constantly running may result in substantial wasteage of printed copies.

It is, accordingly, an object of the present invention to provide procedure and apparatus for enabling the phase adjustment of a vibrating roller in a printing press to be quickly optimized without resorting to trial and error techniques.

More specifically, it is an object of the present invention to provide a series of charts, one for each of a complete set of reference distribution starting angles, each chart showing for each starting angle a corresponding ink density distribution curve which, when matched to the observed ink density distribution in a printed product, provides a direct reading of the optimum starting angle. This enables the optimum starting angle to be set as a simple two-step procedure with accuracy and assurance.

It is another object of the present invention to provide a control system for optimizing the starting angle of a vibrating roller in which the above-mentioned charts are arranged on a carrier permitting any selected one of the charts to be shifted into a reading position and with the carrier being coupled to the phase changer by a servo system so that when the carrier is shifted to indicate a different starting angle the phase changer is shifted automatically to produce the same starting angle, thereby permitting convenient remote control of the starting angle.

In accordance with one of the aspects of the invention it is an object to provide a control system which may be conveniently operated to bring about an optimum distribution of ink in the printed product in positive easily understood steps and without requiring any particular skill or experience.

Figure 1D:
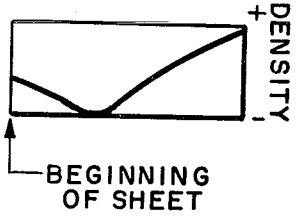
Figure 1:
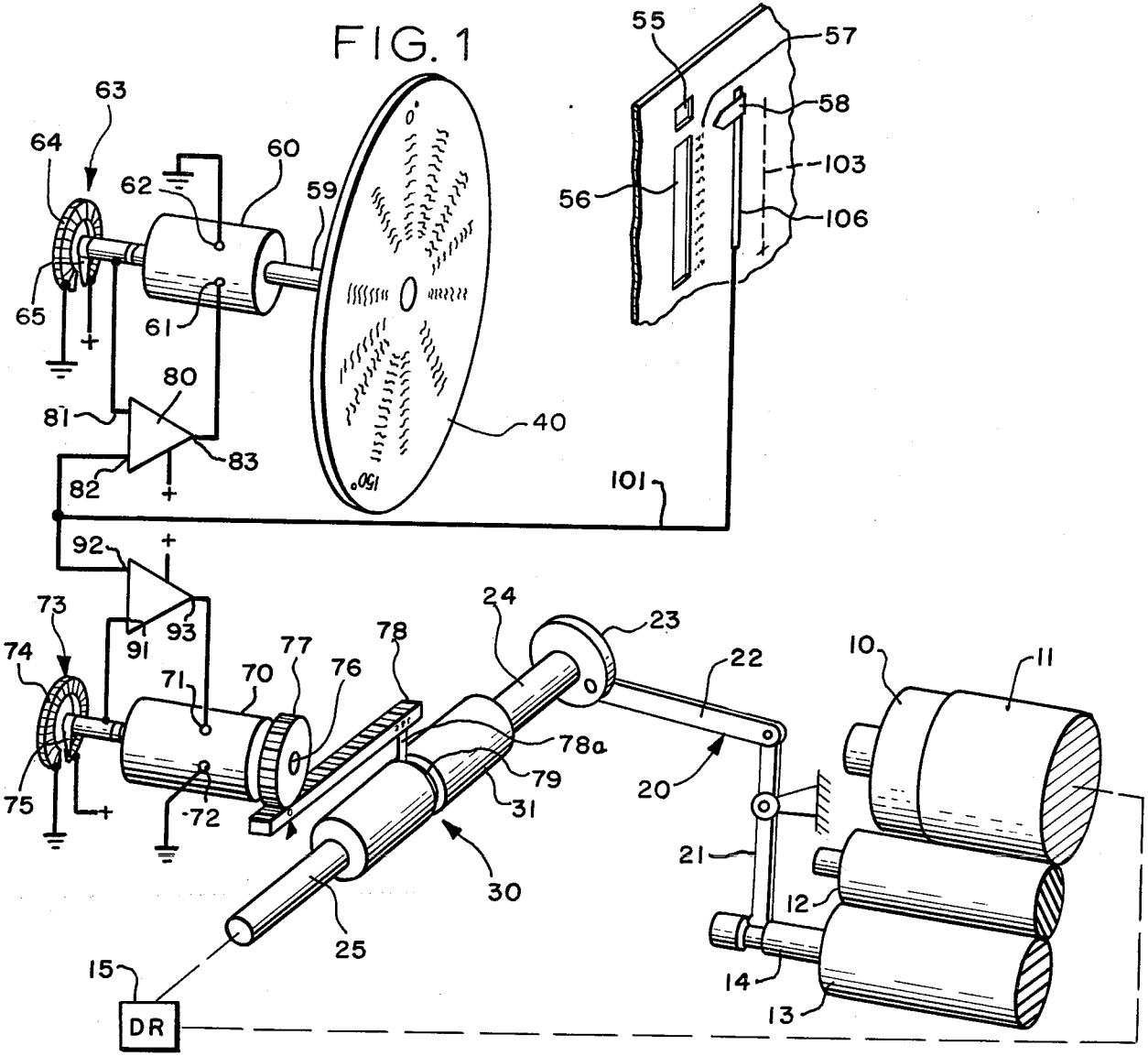

Other objects and advantages of the invention will become apparent upon reading the attached detailed description and upon reference to the drawings in which:

FIG. 1 is a schematic diagram of a control system for optimizing starting angle in accordance with the present invention.

Figure 1A:
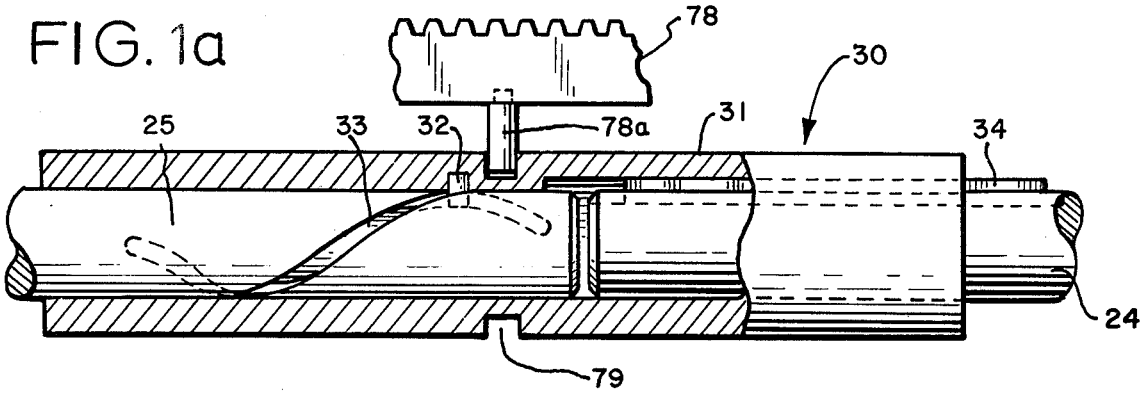

FIG. 1*a* is a fragmentary longitudinal cross section taken through the phase changing sleeve in FIG. 1.

Figure 1B:
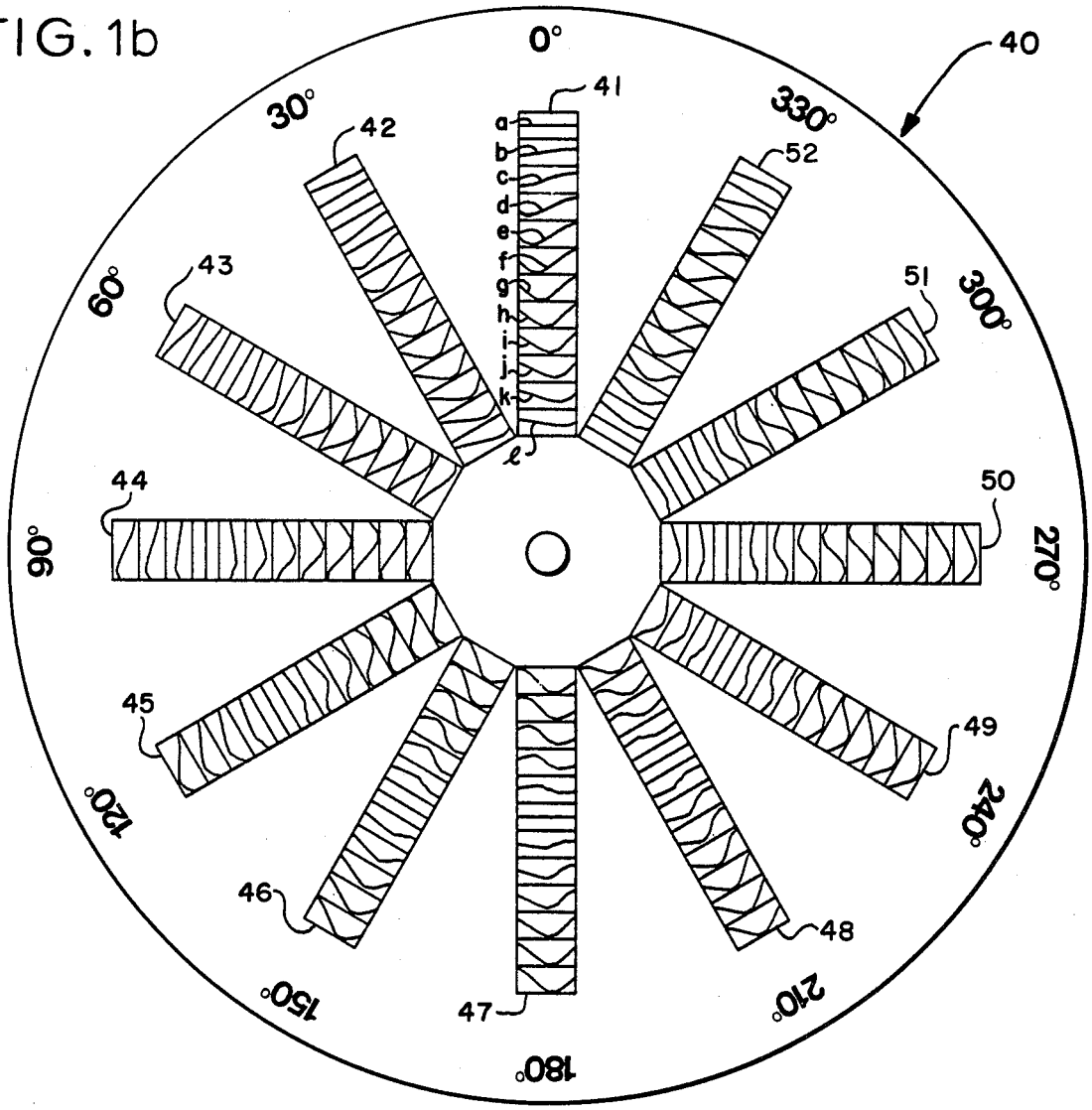

FIG. 1*b* is a layout of the carrier disc which carries the charts for a complete set of reference distribution starting angles.

FIG. 1*c* is a view of one of the charts, for starting angle zero, as viewed in reading position FIG. 1*d* is a graphic representation of the variation in density in a printed sample sheet illustrating a match with the 150° starting angle in FIG. 1*c*.

Figure 2A:
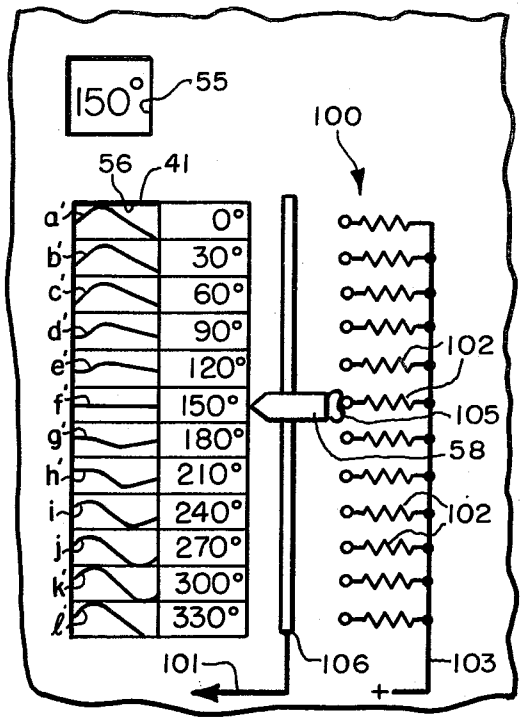
Figure 2:
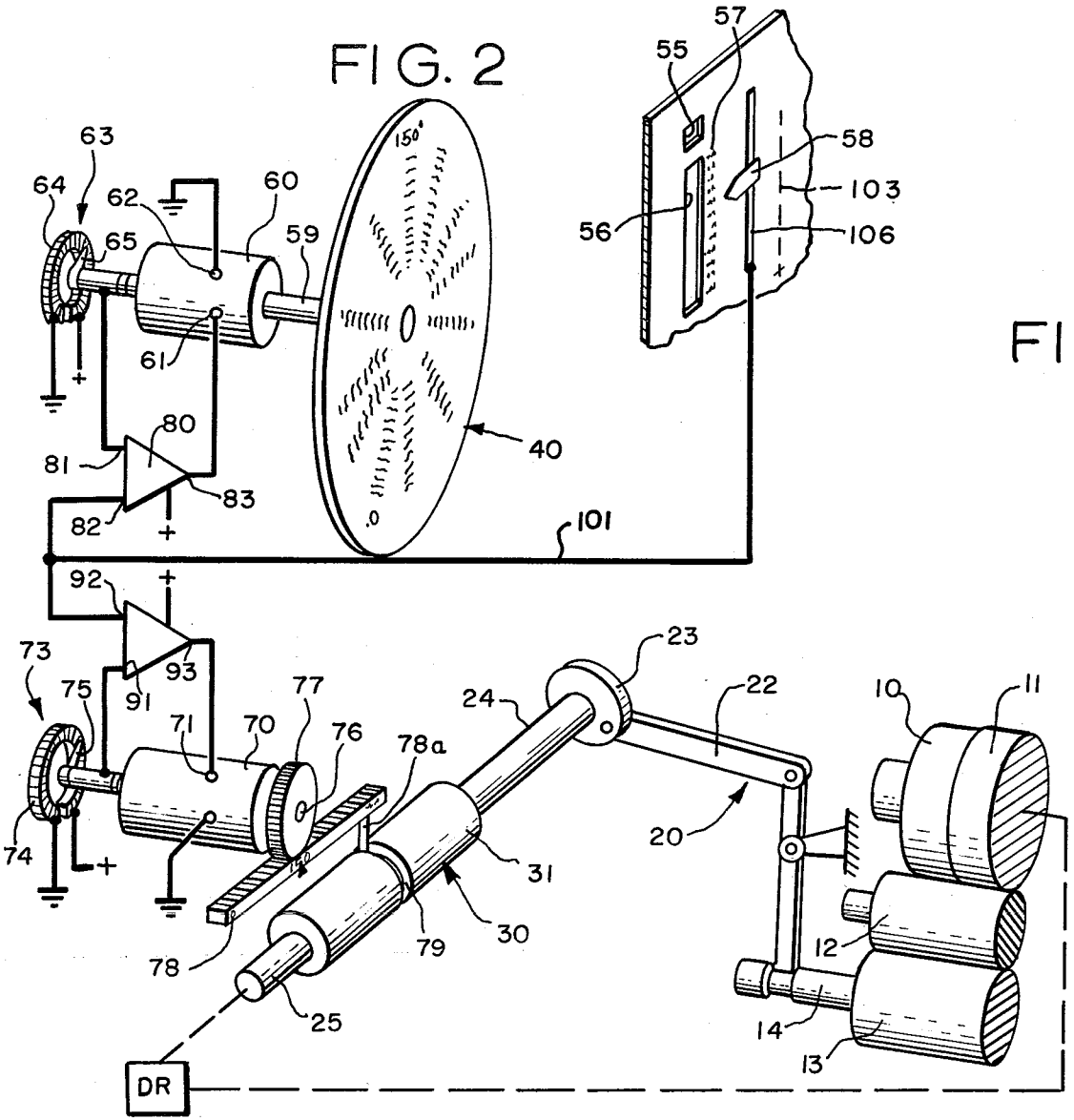

FIG. 2 is a view similar to FIG. 1 but showing the disc and phase changer shifted and with the latter in optimum position.

FIG. 2*a* shows the 150° chart in reading position corresponding to FIG. 2.

Figure 3:
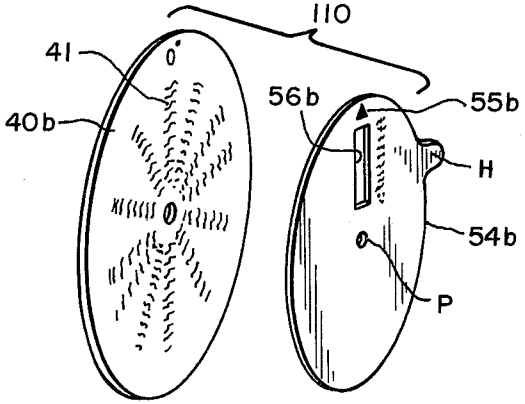

FIG. 3 shows in exploded perspective a pair of discs comprising a simplified form of the present invention.

While the invention has been described in connection with certain preferred embodiments, it is understood that we do not intend to be limited to the particular embodiments shown, but intend, on the contrary, to cover the various alternative and equivalent forms of the invention which may be included within the spirit and scope of the appended claims.

Referring now to FIG. 1 there is shown the plate cylinder 10 of an offset printing press having a plate 11 thereon. An ink film is fed to the plate by a form roller 12 which is engaged by a so-called "vibrating" roller 13 having a shaft 14. The plate cylinder 10 and vibrating roller 13 are coupled to the press drive indicated schematically at 15. For reciprocating the shaft of the vibrating roller 13, a vibrating mechanism 20 is used consisting of an oscillating link 21 and a connecting rod 22 which is connected to a crank 23 driven by an output shaft 24, the latter having an associated input shaft 25 which is powered directly from the press drive 15, as shown. Interposed between the shafts 24, 25 is a phase changing mechanism 30 (FIG. 1*a*) for which more detailed reference may be made to the above-mentioned U.S. Patent. It will suffice to say that the phase changing mechanism includes a sleeve 31 having a pin 32 which engages a helical groove 33 formed in the shaft 25. A spline type connection, formed by a key 34 exists between the sleeve and the output shaft 24. By sliding the sleeve endwise, as is permitted by the key 34, the pin 32 by reason of its engagement with the groove 33 in shaft 25 twists the shaft relatively into a new phase position, thereby changing the phase of the output shaft 24 and the reciprocating mechanism 20.

In carrying out the present invention a carrier in the form of a disc is provided for each one of a complete set of reference distribution starting angles for the vibrating roller, each chart showing for each starting angle a corresponding ink density distribution curve which when matched to the observed ink density distribution in a sample of a printed product provides direct indication of optimum starting angle. Means are further provided for automatically setting the variable phase changer to produce the optimum starting angle for the vibrating roller. Thus referring to FIG. 1*b* a carrier disc 40 is shown having a set of charts 41–52 angularly arranged at 30° increments, each chart being headed by identification of a reference distribution starting angle for the vibrating roller. Taking the chart 41 corresponding to a zero starting angle it will be noted that it includes a set of twelve density distribution curves indicated a–l inclusive and corresponding to starting angles at 30° increments. Each density curve is based upon observed data for a particular design of press and is dependent upon the press geometry. The significance of the specific shape of the density curves will become clear as the discussion proceeds.

For defining a reading position for the carrier in which a single selected chart is viewable there is, superimposed, in front of the chart, a panel 54 having viewing apertures 55, 56, the latter having a scale 57 for identification of the curves on the carrier with an associated slidable pointer, or index, 58.

The carrier 40 is supported upon a shaft 59 of a servo motor 60 having input terminals 61, 62, with the shaft 59, extended, being coupled to a potentiometer 63 having a circular resistance element 64 engaged by a wiper 65.

For the purpose of shifting the phase changer 30 to produce a desired starting angle of the vibrating roller, a servo motor 70 is provided having terminals 71, 72 with an associated potentiometer 73 formed of a circular resistance element 74 with a wiper 75. The servo motor 70 has an output shaft 76 connected to a gear 77 which meshes with a rack 78. The rack has a pin **78*a* which engages an annular groove 79 formed in the sleeve 31**.

The servo motors have conventional servo circuitry interposed between them including a first differential amplifier 80 having inverted and non-inverted input terminals 81, 82, respectively, and an output terminal 83 together as well as a second differential amplifier 90 having inverted and non-inverted input terminals 91, 92 and an output terminal 93.

For the purpose of generating a control signal which is applied to equal degree to both of the amplifiers for simultaneous synchronized adjustment of the disc 40 and gear 77, input terminals 82, 92 of the differential amplifiers are connected, via a line 101, to a servo adjusting assembly 100 which is made up of resistor elements 102 connected to a voltage bus 103, the resistors having terminals 104 at each of the starting angle levels and which are engaged by a wiper 105 associated with the pointer, or index, 58.

The function of the servo motors and the associated adjusting circuitry is to produce coincidence of angular position between the carrier disc 40 and servo output gear 77, with the geometry of the gear, rack and phase changer being such as to produce a starting angle, for the vibrating roller, which corresponds to the heading of the chart, on disc 40, which is in viewing position.

The operation of the device as thus far described may be understood in connection with FIGS. 1 and 2. In FIG. 1 a reference starting angle for the vibrating roller is chosen to be zero. This is done by sliding the pointer 58 to the zero position. The resulting signals causes the disc to rotate until the "zero" chart shows up in the reading position defined by windows 55, 56 and causes the gear 77 to rotate an equal amount so that the variable phase changer 30 produces a zero starting angle at the vibrating roller. The zero setting of the phase changer 30 may be verified by noting that the vibrating roller will just start "pulling" from its extreme position when the first form roller is opposite the trailing edge of the plate on the plate cylinder. A sample of the printed product is then run off, resulting in preparation of a product density curve as shown in FIG. **1*d***, where ink density is plotted as a "y" coordinate along the length of the sheet taken as the "x" coordinate.

The product density curve is then compared, by the press operator, to the set of density curves in chart 41 (FIG. **1*c***) in an effort to find a match. It will be noted that the closest match (for purposes of example) occurs with curve f corresponding to a starting angle of 150°.

Accordingly, the index is moved to the 150° position. This switches the resistor **102*f* into the circuit which applies the same displacement signal to both of the servo systems via line 101. By servo action, per se well known, this causes the chart 46 corresponding to a starting angle of 150° to appear in the viewing windows as indicated in FIG. 2*a* and also causes the phase changer to shift the starting angle of the reciprocating roller to the optimum value of 150° as shown in FIG. 2. The procedure may be reduced to two simple steps: comparing the observed density curved to that in the corresponding reference chart to secure a match, and then setting the index (or phase changer) accordingly. A confirmatory sample of the printed product may then be taken which should show a flat density distribution as indicated at f' in FIG. 2*a*. In the event that the printed sample does not show a flat density distribution but, on the contrary, resembles more nearly one of the adjacent curves in the chart 46, the process may be repeated for the sake of refinement. It will be apparent that this straightforward, simple procedure may be performed in a small fraction of the time required by the prior rather laborious cut and try procedures. The "down time" required for adjustment of the press prior to a run is minimized which, stated conversely, means that the useful output of the press can, using the present technique, be substantially increased. Choosing the values for resistors 102 to bring about the result described is a matter well within the skill of the art. If desired, the resistors 102 may be in the form of voltage dividers with the taps thereof brought out for engagement by the slider 58**.

While it is preferred to practice the invention utilizing a servo control system, the invention in its simple aspects may be practiced, if desired, without the servo feature and employing simply the vibrating mechanism 20 and its associated phase changing mechanism 30 in cooperation with a slightly modified form of carrier 40 (FIG. **1*b*). The modification consists of adding to the carrier 40*b* (FIG. 3) a cover disc 54*b*, corresponding functionally to the panel 54 of the earlier embodiment, the cover disc having a pointer 55*b* and an associated viewing window 56*b* with a scale 57*b*. The two discs are pinned together at the axis by a pin P, and one of the discs may be provided with a radial extension or handle H to facilitate selection of one of the charts in the viewing window. Use of the resulting device 110 in connection with a calibrated phase changing device 30, and without the servo system, may be summarized as follows: The phase changer 30 is manually adjusted to correspond to a reference starting angle of the reciprocating roller, preferably zero. Again, the setting of the phase changer 30 may be verified by noting that the vibrating roller will just start "pulling" from its extreme position when the first form roller is opposite the trailing edge of the plate on the plate cylinder. The discs 40*b*, 54*b* (FIG. 4) are rotated relative to one another so that the "zero" chart 41** shows up through the viewing window.

A sample printed sheet is then run and a density curve is prepared therefor as previously discussed in connection with FIG. 1*d*. Such observed density curve is compared to the density curves in the chart 41 until a match is found, the match in the present instance occurring at curve f corresponding to a starting angle of 150°. The variable phase changer 30 is then manually adjusted to correspond to a starting angle of 150° to produce a flat ink density distribution in the printed product, whereupon the printing run can proceed. In the case of multicolor work a separate system, as disclosed, is employed for each of the individual colors.

Where zero is invariably employed as an initial, or reference, starting angle it is possible to optimize the starting angle with the above techniques by using only the chart 41, and such is included within the scope of the invention.

Having understood the nature of the charts 41–52 and the way in which the charts are utilized, further comments are in order as to the procedure used in making up the charts. In the first place a curve can be drawn showing the observed ink feed through a vibrating roller as a function of instantaneous endwise velocity. The flow will be found to be the greatest when the velocity is zero, as it is at the end of the ends of the stroke, and a minimum when the velocity is a maximum at the center of the stroke. Normally the ink density tends to decrease toward the end of a printed sheet since the printing of the body of the sheet tends to use up the locally available ink. The use of the "zero" position, previously defined, as the reference starting angle tends to minimize this fall-off in density and is the reason that a zero starting angle has been chosen for showing in FIG. 1. The individual curves on the charts can then be determined on a theoretical basis. Knowing the amount of ink fed by the vibrating roller at each increment of phase position, this amount is related to the point of inking of the printing plate by measuring the effective length of the flow path to the point of inking in terms of change in phase angle and by taking into account the splits in the ink flow path before the ink from the vibrating roller actually reaches the plate. The effect of a split according to one hypothesis is that the variation which would otherwise occur is cut in half at each splitting. In accordance with another hypothesis (proposed by Ruder) the sum of the ink film densities before and after the ink gap is the same and the ink is evenly divided by reason of the split. The height of the amplitude of each individual ink flow is calculated based upon the average ink flow at each vibrating roller splitting point, and the number of splitting points being passed. The resulting theoretical variation in ink density can be readily confirmed based upon observed data. Thus, if at a reference starting angle of zero the result is to produce a particular density variation on the printed sheet such as that indicated at f in chart 41, the question is posed as to the amount of shift of starting angle which will produce a flat density variation. In answering this question samples are taken at various increments of shift in order to find the increment which will produce the desired flat density. In the event that it is observed that a shift to a starting angle of 150° will produce a flat density variation, then the observed density curve is entered into the chart at the 150° position, this process being repeated for each of the observed density characteristics at a given reference starting angle and for each incremental reference starting angle.

To summarize, then, the procedure for determining the optimum starting angle under a given set of practical press conditions is simply to (a) establish a reference starting angle in the vibrating mechanism, preferably zero for reasons discussed, (b) run a sample from which a plot of density along the length of the sheet is constructed, (c) match the plot to one of the density curves in the chart being used resulting in a direct reading of optimum starting angle and then (d) set the vibrating mechanism to such optimum angle which should result in a flat distribution of density in the subsequently printed product.

What is claimed is:

1. In a printing press having a plate cylinder with a drive and an inking system which includes a form roller and a vibrating roller having a variable starting angle, the printing press further having a reciprocating drive connection from the drive to the vibrating roller for reciprocation of the latter, a control system for optimizing the starting angle of the vibrating roller for production of an even distribution of ink on the plate which comprises a variable phase changer interposed in the drive connection, a chart for each one of a complete set of reference distribution starting angles for the vibrating roller, each chart showing for each starting angle a corresponding ink density distribution curve for matching to the observed ink density distribution in a printed product, shiftable means for selecting a chart corresponding to a predetermined reference starting angle, a first servo device coupled to the shiftable means, a second servo device coupled to the phase changer, and servo circuitry between the devices including a manually settable element for obtaining positional synchronization at a manually settable position so that following identification of a matching ink density curve corresponding to an optimum starting angle shifting of the shiftable means to correspond to such starting angle results in a corresponding shift of the phase changer to establish such optimum starting angle at the reciprocating roller.

2. In a printing press having a plate cylinder with a drive and an inking system which includes a form roller and a vibrating roller having a variable starting angle, the press further having a reciprocating drive connection from the drive to the vibrating roller for reciprocating of the latter, a control system for optimizing the starting angle of the vibrating roller for production of an even distribution of ink on the plate which comprises a variable phase changer interposed in the drive connection, a relatively movable carrier carrying a chart for each one of a complete set of reference distribution starting angles for the vibrating roller, means cooperating with the carrier for defining a chart reading position, each chart showing for each starting angle a corresponding ink density distribution curve which when matched to the observed ink density distribution in a printed product provides a direct reading of the optimum starting angle, a first servo motor connected to the carrier, a second servo motor connected to the phase changer, servo adjusting means including a manual selector and coupled to both servo motors for (a) bringing a chart of a selected distribution starting angle into reading position and for (b) adjusting the variable phase changer to produce a corresponding starting angle for the vibrating roller.

3. In a printing press having a plate cylinder with a drive and an inking system which includes a form roller and a vibrating roller having a variable starting angle, the press further having a reciprocating drive connection from the drive to the vibrating roller for reciprocation of the latter, a control system for optimizing the starting angle of the vibrating roller for production of an even distribution of ink on the plate which comprises a variable phase changer interposed in the drive connection and having an input gear, a rotatable carrier disc carrying a chart for each one of a complete set of reference distribution starting angles for the vibrating roller, the charts being arranged in equally angled positions on the disc, each chart showing for each starting angle a corresponding ink density distribution curve which when matched to the observed ink density distribution in a printed product provides a direct reading of the optimum starting angle, a first servo motor connected to the carrier, a second servo motor connected to the input gear of the phase changer, servo circuitry for maintaining angular coincidence between the disc and the gear, angle selector means including a relatively shiftable manual index, signal generator means coupled to the index for generating a variable servo control signal for setting the disc and for adjusting the variable phase changer to produce a corresponding starting angle for the vibrating roller.

* * * * *